United States Patent [19]

Rankel

[11] 4,430,206

[45] Feb. 7, 1984

[54] DEMETALATION OF HYDROCARBONACEOUS FEEDS WITH $H_2S$

[75] Inventor: Lillian A. Rankel, Princeton, N.J.

[73] Assignee: Mobil Oil Corporation, New York, N.Y.

[21] Appl. No.: 448,132

[22] Filed: Dec. 9, 1982

Related U.S. Application Data

[63] Continuation-in-part of Ser. No. 220,557, Dec. 29, 1980, abandoned.

[51] Int. Cl.[3] ..... C10G 7/00; C10G 45/00

[52] U.S. Cl. ..... 208/251 R; 208/251 H; 208/252

[58] Field of Search ..... 208/251 H, 251 R, 252

[56] References Cited

U.S. PATENT DOCUMENTS

| | | | |
|---|---|---|---|
| 2,683,683 | 7/1954 | Mills | 196/23 |
| 2,778,779 | 1/1957 | Donaldson | 196/50 |
| 2,914,470 | 11/1959 | Johnson et al. | 208/264 |
| 3,303,126 | 2/1967 | Gleim | 208/251 |
| 3,331,769 | 7/1967 | Gatsis | 208/210 |
| 3,622,498 | 11/1971 | Stolfa et al. | 208/108 |
| 3,915,842 | 10/1975 | Gatsis | 208/108 |
| 4,029,571 | 6/1977 | Curtin | 208/251 |
| 4,046,674 | 9/1977 | Young | 208/251 |
| 4,069,140 | 1/1978 | Wunderlich | 208/251 |
| 4,141,820 | 2/1979 | Sullivan | 208/251 |

FOREIGN PATENT DOCUMENTS

| | | |
|---|---|---|
| 54-33504 | 12/1979 | Japan . |
| 110985 | 7/1961 | Pakistan . |

*Primary Examiner*—Delbert E. Gantz
*Assistant Examiner*—Helane E. Maull
*Attorney, Agent, or Firm*—Alexander J. McKillop; Michael G. Gilman; Stanislaus Aksman

[57] ABSTRACT

Metallic contaminants, such as selenium, arsenic, iron and sodium are removed from a hydrocarbonaceous fluid feed stream by contacting the feed stream with a gas comprising substantially pure hydrogen sulfide ($H_2S$) or a mixture of hydrogen sulfide and hydrogen ($H_2$).

28 Claims, 1 Drawing Figure

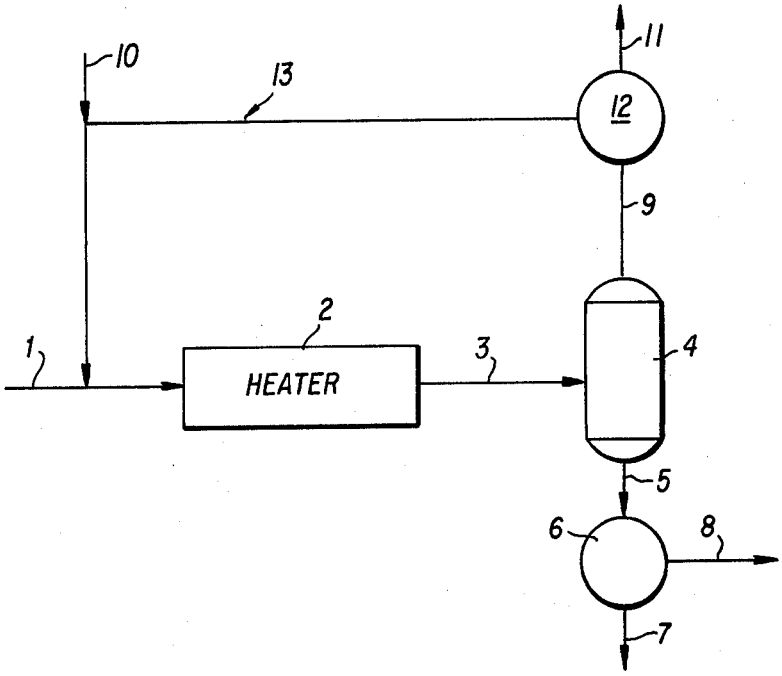
10
13
11
12
9
2
1
HEATER
3
4
5
6
8
7

DEMETALATION OF HYDROCARBONACEOUS FEEDS WITH $H_2S$

CROSS-REFERENCE TO RELATED APPLICATION

This application is a continuation-in-part of a copending U.S. patent application, Ser. No. 220,557, filed Dec. 29, 1980 now abandoned, the entire content of which is incorporated herein by reference.

BACKGROUND OF THE INVENTION

1. Field of the Invention

This invention relates to demetalation of hydrocarbonaceous feeds. More particularly, this invention relates to an improved method of noncatalytic demetalation of hydrocarbonaceous fluid feeds using a pressurized guard bed or a heat soak zone upstream from hydroprocessing units.

2. Description of Prior Art

Increasing worldwide demand for petroleum products combined with continuously increasing prices for petroleum and products recovered therefrom, has prompted a renewed interest in the sources of hydrocarbons which are less accessible than crude oil of the Middle East and other countries. Alternative sources of energy have been known for a long time, however, the methods of exploration and processing of these sources have not thus far been economically competitive with the traditional sources of petroleum. However, increasing demand for petroleum products, and the resulting continuous increases in prices thereof, makes it apparent that formerly noncompetitive sources of energy will become competitive in the near future and therefore will supply a substantial amount of our energy needs. One of the more promising sources of hydrocarbons that will be used in the future to supply our growing demand are synthetic hydrocarbonaceous fluids obtained from oil shale, normally solid coal, tar, including tar sands, etc. These hydrocarbonaceous fluids are generally referred to by generic terms, such as "synthetic crude oil" or "synthetic oil fractions." The term hydrocarbonaceous fluids as used herein is not limited to synthetically-derived hydrocarbons. The term refers to hydrocarbon fluids derived from conventional sources, e.g., petroleum, and from the alternative sources of energy, e.g., shale oil, tar sands and coal fluids.

One of the problems encountered in processing the aforementioned hydrocarbonaceous fluids resides in the presence of heavy metal contaminants therein which affect the ease of processing of such fluids into satisfactory sources of energy and into precursors for the synthesis of other desired materials, e.g., plastics, resins, etc. For example, shale oil contains appreciable quantities of iron, selenium and arsenic, which are potential hydrotreating catalysts poisons. Accordingly, such impurities must be removed from shale oil and other sources of hydrocarbons prior to processing the shale oil in unit operations containing catalysts which may be poisoned by the impurities contained therein.

Attempts have been made in prior art to remove such contaminants by means of catalytic or noncatalytic methods. Thus, for example, catalytic methods of removal of arsenic are disclosed in U.S. Pat. Nos. 3,622,498 and 3,496,099, while noncatalytic methods are disclosed in U.S. Pat. No. 2,778,779. In addition, U.S. Pat. No. 4,029,571 discloses the thermal "heat soak" demetalation method, whereby arsenic and heavy metal contaminants are precipitated from shale oil in the presence of hydrogen, with or without the use of a separate hydrogenation step. A similar process is also disclosed by Sullivan et al in *Catalytic Hydroprocessing of Shale Oil to Produce Distillate Fuels,* ADVANCES IN CHEMISTRY, Vol. 179, pages 25–51 (1979). The entire contents of all of the aforementioned patents and publications are incorporated herein by reference.

However, the prior art methods of removing heavy metal and other contaminants from shale oil and other hydrocarbonaceous fluids have met only with partial success because a substantial portion of contaminants remained in the hydrocarbonaceous fluid feeds.

Accordingly, it is the primary object of the present invention to provide an improved process for the removal of heavy metals and other contaminants from hydrocarbonaceous fluid feed streams.

It is an additional object of the present invention to provide an improved non-catalytic process for removing heavy metals contaminants from shale oil.

Additional objects of this invention will become apparent to those skilled in the art from the study of the specification and the appended claims.

SUMMARY OF THE INVENTION

These and other objects have been met by providing a non-catalytic process for removal of heavy metals, e.g., selenium, arsenic, and iron, from a hydrocarbonaceous fluid feed stream by contacting the stream with a gas comprising hydrogen sulfide ($H_2S$) or a mixture of hydrogen sulfide and hydrogen. In one embodiment, the gas contacts the hydrocarbonaceous fluid feed stream in a heater and the mixture is then passed to a heat soak zone for a sufficient time to cause the metallic contaminants to precipitate out of the feed. The precipitate can then be removed by a physical separation means (e.g., a centrifuge or decanting after settling).

In an alternative embodiment, the gas contacts hydrocarbonaceous fluid feed stream in a guard bed filled with a porous inert material, e.g., alumina. The thus-formed metals-containing precipitate can be completely removed by the porous material, or it can be partially removed by the porous material and partially by a suitable physical separation means depending on the surface area of the porous material.

BRIEF DESCRIPTION OF THE FIGURE

The FIGURE is a schematic representation of the process of this invention.

DETAILED DESCRIPTION OF THE INVENTION

The process of this invention can best be described by referring to a schematic illustration thereof in the appended FIGURE.

In the FIGURE, the hydrocarbonaceous fluid feed stream is introduced into the process through a feed conduit 1, which then conducts it to a heater 2. A pressurizing gas (either a substantially pure hydrogen sulfide or a mixture of hydrogen sulfide and hydrogen, as set forth in detail below) is introduced into the process through a make-up conduit 10 and through a recycle conduit 13. The pressurizing gas is combined with the feed stream so that it is thoroughly admixed therewith. The combined stream of feed and of the pressurizing gas is heated to a desired temperature and under desired pressure conditions in the heater 2, from which it is removed via a conduit 3. The heated stream is then passed to a heat soak zone (or thermal holding zone) 4, which is sized to provide sufficient residence time to allow the heated hydrocarbonaceous fluid feed stream to be maintained at the desired temperature and pressure conditions to allow for the formation of a precipitate. In some instances, the operating temperature and pressure conditions of the heater 2 are such that they allow for the formation of the precipitate of heavy metals, in which case, the thermal holding zone 4 can be reduced in size or even totally eliminated. Following the desired residence time in the heat soak zone 4, the treated hydrocarbonaceous fluid is withdrawn as a liquid through the conduit 5 and conducted to a suitable separation means 6, such as a centrifuge, gravity settlers, filters containing a high surface area material, such as clay, manganese nodules or metal oxides, which are insoluble in the oil and easily separate from the oil, or to any other conventional separating means well known in the art, wherein at least a portion of the precipitate formed in the heat soak zone 4 is removed through a conduit 7. The product oil containing a fraction of metallic contaminants contained in the hydrocarbonaceous fluid feed stream is withdrawn through a product conduit 8. If desired, the thermal holding zone 4 can be equipped with an overhead vapor conduit 9 to remove vaporized oil and the pressurizing gas. The conduit 9 passes the mixture of the pressurizing gas and the vaporized oil to a gas separation means 12, commonly known in the art, e.g., high-pressure gas-liquid separator followed by a low pressure gas-liquid separator, wherein the vaporized hydrocarbons are withdrawn by a conduit 11 and the pressurizing gas is recycled to the process through a conduit 13. A make-up pressurizing gas may be added to the process through the conduit 10, as discussed above.

In an alternative embodiment, discussed in detail below, the heat soak zone is replaced by a guard chamber filled with a porous inert material which is capable of removing the metal contaminants from the hydrocarbonaceous feed. Suitable porous inert materials are refractory oxides selected from the group consisting of the oxides of the elements of Groups IIA, IIB, IIIA, IIIB, IVA and IVB of the Periodic Table, and/or naturally occurring high surface area inert materials, e.g., clays, coals, sands, and manganese nodules. The guard bed can be filled with any one of the aforementioned porous materials or with any suitable combination thereof. The guard chamber is of a conventional design well known in the art, and it is operated in a conventional manner and acts as a medium for the deposition of contaminant metals. The alternative embodiment of this invention is operated in the same manner as the embodiment using the heat soak zone. Accordingly, all of the process conditions and parameters discussed herein in connection with the operation of the process containing the heat soak zone also apply to the alternative embodiment using the inert material-filled guard chamber.

The hydrocarbonaceous fluids that can be treated in accordance with the process of this invention are hydrocarbonaceous fluids obtained from oil shale, normally solid coal, tar (including tar sands) and any combinations or fractions thereof. The process of this invention is also applicable to the removal of metallic impurities from the full range of hydrocarbonaceous fluids, including bitumen, coal liquids, and all metal containing oils from both petroleum derived and also syncrude derived sources. In certain processes of the prior art, the hydrocarbonaceous fluids described above may be referred to as synthetic crude or synthetic oil fractions. Thus, the term hydrocarbonaceous fluid feed stream, as used herein, is meant to include any single one or any combination of the materials set forth above, including synthetic crude or oil fractions.

The hydrocarbonaceous fluids, especially shale oil, are known to contain arsenic, selenium and iron impurities or metal contaminants and other impurities, e.g., sodium and calcium. The process of the present invention provides a relatively simple and effective method of removal of such metal contaminants by forming a precipitate which can be removed from the feed fluids by any well known physical separation means. The term metal contaminants as used herein encompasses any metal components present in the hydrocarbonaceous fluids, for example, iron, sodium, calcium, arsenic, selenium, or other metals capable of forming metal sulfides under the reaction conditions. The term precipitate, as used herein, refers to any solid or semisolid material capable of being physically separated from the fluid portion of the heat treated hydrocarbonaceous fluid. The precipitate may be in the form of hard particles of soft waxy or tarry materials which are easily separated from the liquid portion of the heat treated hydrocarbonaceous fluid by any well known physical separation means. Such physical separation means include separation means wherein the precipitate can be separated from the liquid portion of the heat treated hydrocarbonaceous fluid by well known size or gravity separation principles and techniques, including settling, followed by decantation, filtration, centrifugation and the like. The precipitate obtained in the process of this invention contains significant amounts of the arsenic, sodium, calcium and iron contaminants originally present in the hydrocarbonaceous fluid feed. In particular, it has been found that the use of a pressurizing gas comprised of a substantially pure hydrogen sulfide or a mixture of hydrogen sulfide and hydrogen results in the removal of about 88% of the metallic contaminants, as compared to only about 71% for the processes of the prior art which use substantially pure hydrogen gas.

In heat treating the hydrocarbonaceous fluids according to this invention, any conventional method for applying heat to the fluids can be utilized. Thus, conventional heat exchangers (optionally utilizing the heat carried by various process streams of this process), directly and indirectly heated furnaces, and other vessels can be utilized to supply the necessary heat to the hydrocarbonaceous fluids for the heat treating step of this invention. The heat soak zone (thermal holding zone) of this invention can be a conventional vessel, substantially horizontal in shape, or a coiled tube.

In an alternative embodiment, the heat soak zone can be replaced by a conventional guard bed or guard chamber containing alumina or any other porous inert material of moderate surface area (e.g., generally greater than 10 $m^2/g$ with more efficient demetallation occurring as surface area increases) which is generally used upstream (i.e., before) from hydroprocessing units to remove metals from hydrocarbonaceous feeds. If the inert material in the guard bed has a high surface area (e.g., alumina of 50–300 $m^2g$), the inert material will be sufficient to remove the metals. Conversely, if the inert material has a low surface area (e.g., Vycor of 1–10 $m^2/g$), then the metals will be partially removed by the inert material and partially by other physical separation means, e.g., separation means 6, as would be obvious to those skilled in the art. The porous material in the guard bed removes a portion of the precipitate in a conventional manner as described in detail in U.S. Pat. No. 4,141,820, or in a manner similar to U.S. Pat. No. 4,003,829 (but without the addition of transition metal-containing materials to the inert material in the guard bed). The entire contents of both of these patents are incorporated herein by reference. The porous material is usually alumina, but it can also be other high surface area materials, such as metal oxides ($SiO_2$, $TiO_2$, etc.)

In the embodiment wherein the heat soak zone without the inert material is used, the contaminants-containing precipitate is removed by any conventional physical separation means, e.g., centrifugation, settling followed by decantation, filtration, etc. The heat treatment of the hydrocarbonaceous fluid in accordance with this invention is conducted at a temperature of at least 600° F. or about 316° C. The maximum temperature of the heat treating step is a function of the length of time the fluid is maintained at that temperature and of the amount of cracking or coking which can be tolerated during the heat treating step. The heat treating step can be normally carried out at a temperature of from about 600° F. to about 800° F., or about 316° C. to about 430° C., respectively, preferably at the temperature of about 600° F. to about 750° F. or about 316° C. to about 400° C., respectively.

The pressure of the heat treating step is preferably a pressure at which a substantial portion (e.g., from 1% to 99%, preferably 80% to 90%, most preferably 84% to 88%) of the hydrocarbonaceous fluid being processed is maintained in a liquid phase. Generally, the pressure of the heat treating step is at least 15 psig (about 1 atm), and preferably about 15 psig to about 5000 psig (about 341 atm), most preferably 200 psig (about 15 atm) to 2000 psig (about 137 atm).

As noted above, the process of this invention can be carried out either with a substantially pure (100% by volume) stream of gaseous hydrogen sulfide ($H_2S$), or with a gas comprising a combination of $H_2S$ and hydrogen ($H_2$) as the pressurizing gas for the guard chamber or the heat soak zone. When the pressurizing gas comprises a mixture of $H_2S$ and $H_2$, it generally contains about 40% to about 100%, preferably about 50% to 100%, and most preferably about 65% to about 100% by volume $H_2S$, the remainder being substantially pure hydrogen.

It has been found that the use of either substantially pure hydrogen sulfide gas or a mixture of hydrogen sulfide and hydrogen, as set forth above, results in the removal of about 88% of the sum of all metal contaminants (As, Na, Ca and Fe), as compared to only about 71% removal rate when substantially pure hydrogen is used under identical process conditions (i.e., maintaining the synthetic hydrocarbonaceous fluids in the guard bed in the presence of the pressurizing gas for about one hour).

The length of time the hydrocarbonaceous fluids are maintained at the elevated temperature in the thermal holding zone, the guard chamber, and/or in the heater (the residence time) will vary, in a manner apparent to those skilled in the art, depending on the temperature and pressure conditions thereof, as well as on the amount of cracking and coking that can be tolerated during the heat treating step. When the temperature and pressure conditions in the thermal holding zone or in the guard bed are relatively mild (e.g., about 650° F. and about 500 psig), the residence time is relativey long (e.g., 30–60 minutes). Conversely, at more severe conditions (e.g., 800° F. and 500 psig), the residence time is relatively short (e.g., less than 30 minutes). Generally, the hydrocarbonaceous fluids should be maintained at the elevated temperature sufficiently long to remove a substantial proportion of metals, but not long enough to cause the formation of a large amount of residue. The residue must be discarded, and hence it represents wasted, potentially useful hydrocarbons. Thus, the hydrocarbonaceous fluids should be maintained at the elevated temperature for such a time that the amount of residue is less than 20% by weight (wt.%), preferably less than 15 wt.% of the product.

Generally, the residence time of the hydrocarbonaceous fluid is at least 1 second to 360 minutes, preferably 5 minutes to 100 minutes, and most preferably 40 minutes to 80 minutes. It will be apparent to those skilled in the art that the hydrocarbonaceous fluids may be maintained for the entire residence time in the thermal holding zone or in the guard chamber or in the heater, or the residence time may be apportioned in any desired manner between the heater, the guard chamber, and the thermal holding zone, depending on the desired end result, so long as the sum of residence times falls within the time limits specified above.

Following the heat treating and separation steps to remove at least a portion of the metallic contaminants, the hydrocarbonaceous fluid, having reduced impurity levels, can be refined, treated or used in any desirable manner. Because of the low levels of arsenic and selenium contamination, the treated products produced with this invention are particularly applicable to subsequent refining and/or treatment steps wherein operations would be impaired if the arsenic and selenium contaminants were present.

An additional advantage of the present invention resides in that the conversion of the hydrocarbonaceous feed material to the hydrocarbons boiling in the range commonly referred to as the "gasoline boiling range" (i.e., a boiling point of about 450° F. or about 230° C.) is about 13.5%, as compared to a conversion of only about 9.5% in a prior art process conducted under identical conditions but using substantially pure hydrogen ($H_2$).

Another advantage of the present invention involving the use of hydrogen sulfide ($H_2S$) resides in the greater pour point reduction achieved with the $H_2S$-treated hydrocarbonaceous feeds as compared to $H_2$-treated feeds. Without wishing to be bound by any theory of operability, the pour point reduction is probably achieved by the generation of sulfur-containing pour point depressants derived from the added $H_2S$ (A. Schilling, *Motor Oils and Engine Lubrication,* Scientific Publ., Great Britain, 1968, Chapter 2). This is also consistent with the higher sulfur content of the liquid product. Thermal treatment alone with hydrogen ($H_2$) gives only a slight pour point decrease.

$H_2S$-treated oils have lower molecular weights than $H_2$-treated oils. Lower molecular weight oils are easier to process.

The following examples illustrate specific non-limitative embodiments of the invention. All temperatures are in degrees centigrade (°C.), all pressures in atmospheres (atm), and all percent proportions in percent by weight, unless otherwise indicated.

EXAMPLES 1–3

A Paraho Shale Oil was heated in the presence of either 100% $H_2S$ or 100% $H_2$ pressurizing gases in a stirred autoclave. After quenching the reaction and cooling, the oil from the autoclave was centrifuged at 8000 rpm for ½ hour, decanted from the centrifuge cans, and analyzed.

The autoclave was heated at a constant rate and held at the temperature of 750° F. (399° C.) either for 0 hours or 1 hour. Table 1 shows analysis of the treated centrifuged oils and of the feed.

TABLE 1

Analysis of Centrifuged Shale Oil Treated With Heat in the Presence of $H_2$ or $H_2S$

| | Shale Oil Feed | Example No. 1 | 2 | 3 |
|---|---|---|---|---|
| Temp. (°C.) | | 399 | 399 | 399 |
| Pressure (atm) | | 16.7 | 21 | 24.5 |
| Time, hrs. | | 0 | 1 | 1 |
| Pressurizing Gas Used | | $H_2S$ + He | $H_2$ | $H_2S$ + He |
| Material Balance | | 98% | 98% | 97% |
| Mole Ratio H/C | 1.55 | 1.54 | 1.59 | 1.59 |
| % N, Total | 2.27 | 2.08 | 2.23 | 2.16 |
| % N, Basic | 1.33 | 1.31 | 1.32 | 1.30 |
| % S | 0.84 | 1.08 | 0.79 | 1.18 |
| % O | 1.03 | 1.04 | 0.92 | 0.5 |
| As ppm | 32 | 9 | 2 | 2 |
| Na ppm | 14 | 6.5 | 12 | 4.9 |
| Ca ppm | 2.5 | 0.84 | 0.49 | 0.47 |
| Fe ppm | 46 | 6.5 | 13.0 | 4.0 |
| Total ppm metal | 94.5 | 22.8 | 27.5 | 11.4 |
| % Demetalation | | 76 | 71 | 88 |
| deN (Total N) | | 8.4 | 1.8 | 4.8 |
| Mol wt. | 637 | 341 | 442 | 389 |
| Wt. % residue | | 0 | 1.1 | 0 |
| Wt. % gases | | 0.4 | 0.7 | 1.6 |

Boiling Point Conversions (% by volume)

| Example No. | | Ambient-Gases | 420-420° F. 650° F. | 650-850° F. | 850-1075° F. | 1075° F.+ | to 420° F. BP Fraction | Conversion |
|---|---|---|---|---|---|---|---|---|
| | Paraho Shale | | 7.5 | 28.2 | 34.3 | 15.8 | 14.2 | |
| 1 | 750° F., 0 hrs, $H_2S$ + He | 3.5 | 9.2 | 25.7 | 26.6 | 21.5 | 16.7 | 5.6 |
| 2 | 750° F., 1 hr., $H_2$ | 0.7 | 15.5 | 21.3 | 27.2 | 12.2 | 23.1 | 9.4 |
| 3 | 750° F., 1 hr., $H_2S$ + He | 1.6 | 18.3 | 26.4 | 26.5 | 9.9 | 17.2 | 13.4 |

Formula for Conversion to 420° F.:

$$\frac{(420° F.^{-} \text{ liq.} + \text{gas}) - 7.5}{92.5}$$

Helium (He) was used with $H_2S$ in Examples 1 and 3 to provide a relatively easily compressible pressurization gas. However, the helium is inert to the reactants and it did not chemically react with $H_2S$ or the shale oil.

As can be seen from Table 1, pressurization of the autoclave with $H_2S$ at 750° F. (399° C.) for 1 hour removes 88% of the metals (iron, Fe; arsenic, As; calcium, Ca; and sodium, Na), while pressurization with $H_2$ under the same conditions removes only 71% of the metals. The $H_2S$-treated oil has lower molecular weight, less total nitrogen (N), and conversion to 420° F. material has occurred as well.

The boiling point conversion to the gasoline range (420° F. boiling point-BP) is 13.4% when $H_2S$ and He at 750° F. for one (1) hour is used, as compared to 9.4% conversion for the treatment with $H_2$ alone.

EXAMPLES 4-5

200 grams of Paraho Shale Oil was charged to a stirred autoclave (300 cc volume), which was then flushed with helium. Hydrogen ($H_2$) or hydrogen sulfide ($H_2S$) gas at 100 psig (5.8 atm) was added to the autoclave. The autoclave was heated to 800° F. (427° C.) and held at that temperature for one (1) hour, followed by immediate ice-water quench. The oil was centrifuged, decanted from the centrifuge cans and analyzed.

TABLE II summarizes the conditions and results of the experiments.
Analysis of Centrifuged Shale Oil Treated With Heat in the Presence of $H_2$ or $H_2S$

| | Shale Oil Feed | Example No. 4 | 5 |
|---|---|---|---|
| Temp. (°C.) | | 427 | 427 |
| Pressure (atm) | | 43.2 | 46.6 |
| Time, hrs. | | 1 | 1 |
| Pressurizing Gas Used | | $H_2$ | $H_2S$ |
| Mole Ratio H/C | 1.55 | 1.56 | 1.51 |
| % N, Total | 2.27 | 2.05 | 2.16 |
| % N, Basic | 1.33 | 1.29 | 1.30 |
| % S | 0.84 | 0.48 | 0.68 |
| % O | 1.03 | 1.93 | 0.89 |
| As ppm | 32 | 1 | 1 |
| Na ppm | 14 | 5.2 | 5.2 |
| Ca ppm | 2.5 | 0.98 | 1.0 |
| Fe ppm | 46 | 3.5 | 2.5 |
| Total ppm metal | 94.5 | 10.7 | 9.7 |
| % Demetalation | | 89% | 90% |
| Mol. wt. | 637 | 423 | 369 |
| Residue | | | |
| M.W. | | 240 | 444 |
| ppm As | | 17 | 29 |
| Wt. % | | 11.0 | 13.0 |
| Wt. % gases | | 4.0 | 3.5 |

Boiling Point Conversions (% by volume)

| Example No. | | Gases | Ambient-420° F. | 420-650° F. | 650-850° F. | 850-1075° F. | 1075° F.+ | Conversion to 420° F. BP Fraction |
|---|---|---|---|---|---|---|---|---|
| | Paraho Shale | | 7.5 | 28.2 | 34.3 | 15.8 | 14.2 | |
| 4 | 800° F., 1 hr., | 3.6 | 22.2 | 22.9 | 21.4 | 5.4 | 25.9 | 19.8 |

-continued

| Example No. | | Gases | Boiling Point Conversions (% by volume) Ambient–420° F. | 420–650° F. | 650–850° F. | 850–1075° F. | 1075° F.+ | Conversion to 420° F. BP Fraction |
|---|---|---|---|---|---|---|---|---|
| 5 | $H_2$ 800° F., 1 hr., $H_2S$ | 3.1 | 21.5 | 24.0 | 17.8 | 3.6 | 31.6 | 18.5 |

As seen above, pressurization of the autoclave with $H_2S$ for one (1) hour at 800° F. (427° C.) results in greater demetalation of the feed shale oil than the identical treatment with $H_2$.

EXAMPLES 6–7

Runs were conducted on the Paraho shale oil in a ¼ in. coiled stainless steel tube reactor 144 in. long. In the thermal runs, the reactor was packed with 50 cc of 20/30 mesh vycor and heated by a fluidized bath to 750° F. The LHSV was 0.6 based on the volume of the empty tube. The vycor-filled tube reactor had a surface area of approximately 0.4–1.0 meter-square. This surface area was at least 40–100 times greater than the previous autoclave used in Examples 1 through 5.

The oil was fed into the reactor by an Isco pump through heated lines (130° C.). A 6 in., ¼ in. stainless steel preheater section (maintained at 500° F.) was placed immediately before the reactor. Each run was conducted in a fresh reactor.

The $H_2$ flow was 3000 SCF/BBL and the pressure was 700 psig. $H_2S$ was added to the $H_2$ stream by using a lquid $H_2S$ bubbler system maintained at 11° C. to give 40 mole % $H_2S$ in $H_2$.

Table III summarizes the results of these experiments.

TABLE III-continued

| Gases Used | Shale Oil Feed | Example No. 6 | 7 |
|---|---|---|---|
| Analysis | | | |
| Basic N | 1.33 | 1.33 | 1.28 |
| Total N | 2.12 | 2.09 | 1.87 |
| O | 1.53 | 1.07 | 1.01 |
| S | 0.81 | 0.39 | 1.32 |
| C | 84.25 | 85.13 | 84.93 |
| H | 11.03 | 11.26 | 11.24 |
| | 99.74 | 99.94 | 100.37 |
| Mole ratio H/C | 1.57 | 1.59 | 1.59 |
| % deN | | 1.4 | 11.8 |
| % deO | | 30.0 | 34.0 |
| % deS | | 51.9 | 0 |
| Trace elements | | | |
| As ppm | 32 | 5 | 1.5 |
| Fe ppm | 46 | 11 | 5 |
| % Demetalation | | 79 | 92 |
| Hydrogen | | | |
| Consumption (SCF/BBL) | | 159 | 145 |
| Wt. % gas make ($C_1$–$C_5$ gases) | | 0.4 | 0.9 |

*Insufficient sample for analysis.

Boiling Range Distribution

| Example No. | | Gases | Boiling Range Distribution Ambient–420° F. | 420–650° F. | 650–850° F. | 850–1075° F. | 1075° F.+ | Conversion to 420° F. BP Fraction |
|---|---|---|---|---|---|---|---|---|
| Shale Oil Feed | | | 7.5 | 28.2 | 34.3 | 15.8 | 14.2 | |
| EX. 6 | 750° F., 700 psig $H_2$ treated | 0.14 | 10.5 | 19.2 | 31.8 | 18.3 | 20.3 | 0 |
| EX. 7 | $H_2S + H_2$ treated | 0.89 | 7.6 | 18.6 | 24.8 | 28.9 | 19.1 | 0 |

In these examples, the product oils were analyzed as received from the reactor. The metals levels of the product oil in Example 7 are lower because $H_2S+H_2$ gases give higher levels of demetallation than $H_2$ alone (Example 6). The As and Fe metals in the oil in Example 7 deposit on the walls of the reactor and vycor glass, mostly as metal sulfide species. Greater pour point reduction is also achieved with the mixture of $H_2S+H_2$.

A higher surface area component in the tube reactor than 20/30 mesh vycor is likely to give better results.

TABLE III

| Gases Used | Shale Oil Feed | Example No. 6 | 7 |
|---|---|---|---|
| | | $H_2$ | $H_2S + H_2$ (40 mol % $H_2S$ and 60 mol % $H_2$) |
| Processed at | | | |
| Pressure (psig) | | 700 | 700 |
| LHSV | | 0.6 | 0.6 |
| Temp. (°F.) | | 750 | 750 |
| Pour point | 80 | 72 | 59 |
| CCR | 2.78 | —* | 2.51 |

It will be apparent to those skilled in the art that the above examples can be successfully repeated with ingredients equivalent to those generically or specifically set forth above and under variable process conditions. From the foregoing specification, one skilled in the art can readily ascertain the essential features of this invention and without departing from the spirit and scope thereof can adapt it to various diverse applications.

What is claimed is:

1. A noncatalytic process for removing at least one metal contaminent from shale oil comprising contacting the shale oil with a gas comprised of about 40% to about 100% by volume of hydrogen sulfide and about 0% to about 60% by volume of hydrogen at a pressure of at least 15 psig and at a temperature of about 600° F. to about 800° F.

2. A process according to claim 1, wherein the gas comprises about 50% to about 100% by volume of hydrogen sulfide and about 0% to about 50% by volume of hydrogen.

3. A process according to claim 2 wherein the gas contacts the shale oil at a temperature of about 600° F. to about 750° F.

4. A process according to claim 3 wherein the gas contacts the shale oil at a pressure of about 15 psig to about 5000 psig.

5. A process according to claim 4 wherein the gas contacts the shale oil for at least 1 second to 360 minutes.

6. A process according to claim 5 wherein the shale oil is contacted with the gas in a guard chamber containing a porous inert material.

7. A process according to claim 6 wherein the at least one metal contaminant is iron, sodium, calcium, arsenic or selenium.

8. A process according to claim 1 wherein the shale oil is contacted with the gas in a heat soak zone.

9. A process according to claim 7 wherein the gas comprises about 65% to about 100% by volume of hydrogen sulfide and about 0% to about 35% by volume of hydrogen.

10. A process according to claim 9 wherein the gas contacts the shale oil at a pressure of 200 psig to 2000 psig.

11. A process according to claim 10 wherein the gas contacts the shale oil for 40 minutes to 80 minutes.

12. A process according to claim 11 wherein the porous inert material is one or more of refractory oxides selected from the group consisting of the oxides of the elements of Groups IIA, IIB, IIIA, IIIB, IVA and IVB of the Periodic Table.

13. A process according to claim 12 wherein the metal contaminant is iron or arsenic.

14. A process according to claim 13 wherein the metal contaminant is arsenic.

15. A process according to claim 8 wherein the gas comprises about 50% to about 100% by volume of hydrogen sulfide and about 0% to about 50% by volume of hydrogen.

16. A process according to claim 15 wherein the gas contacts the shale oil at a temperature of about 600° F. to about 750° F.

17. A process according to claim 16 wherein the gas contacts the shale oil at a pressure of about 15 psig to about 5000 psig.

18. A process according to claim 17 wherein the gas contacts the shale oil for at least 1 second to 360 minutes.

19. A process according to claim 18 wherein the at least one metal contaminant is iron, sodium, calcium, arsenic or selenium.

20. A process according to claim 19 wherein the metal contaminant is iron or arsenic.

21. A process according to claim 20 wherein the metal contaminant is arsenic.

22. A process according to claim 21 wherein the gas comprises about 65% to about 100% by volume of hydrogen sulfide and about 0% to about 35% by volume of hydrogen.

23. A process according to claim 22 wherein the gas contacts the shale oil at a pressure of 200 psig to 2000 psig.

24. A process according to claim 22 wherein the gas contacts the shale oil for 40 minutes to 80 minutes.

25. A noncatalytic process for removing at least one metal contaminant from shale oil comprising contacting the shale oil with a gas comprising 100% by volume of hydrogen sulfide at a pressure of at least 15 psig and a temperature of about 600° F. to about 800° F.

26. A process according to claim 14 wherein the shale oil is contacted with the gas for such a time that the amount of residue in the product is less than 20 weight %.

27. A process according to claim 24 wherein the shale oil is contacted with the gas for such a time that the amount of residue in the product is less than 20 weight %.

28. A process according to claim 25 wherein the shale oil is contacted with the gas for such a time that the amount of residue in the product is less than 20 weight %.

* * * * *

UNITED STATES PATENT AND TRADEMARK OFFICE

CERTIFICATE OF CORRECTION

PATENT NO. : 4,430,206

DATED : February 7, 1984

INVENTOR(S) : LILLIAN A. RANKEL

It is certified that error appears in the above—identified patent and that said Letters Patent is hereby corrected as shown below:

Column 7, Lines 35-41: The headings of the Table entitled "Boiling Point Conversion (% by volume)" are incorrect. The headings should read as follows:

| Example No. | Gases | Ambient -420°F | 420-650°F | 650-850°F | 850-1075°F | 1075°F+ | Conversion to 420°F BP Fraction |
|---|---|---|---|---|---|---|---|

Signed and Sealed this

Thirty-first Day of July 1984

[SEAL]

Attest:

GERALD J. MOSSINGHOFF

Attesting Officer

Commissioner of Patents and Trademarks